US005913690A

United States Patent [19]

Dechelette et al.

[11] Patent Number: 5,913,690

[45] Date of Patent: Jun. 22, 1999

[54] ELECTRICAL GROUNDING SHROUD

[75] Inventors: Helen Dechelette, Paris, France; Karel Reinier de Vries, Nuenen, Netherlands

[73] Assignee: Molex Incorporated, Lisle, Ill.

[21] Appl. No.: 08/943,061

[22] Filed: Oct. 2, 1997

[30] Foreign Application Priority Data

Oct. 12, 1996 [EP] European Pat. Off. ..... 96116389

[51] Int. Cl.[6] ..... H01R 13/652

[52] U.S. Cl. ..... 439/108; 439/607; 439/608

[58] Field of Search ..... 439/101, 108, 439/607, 608

[56] References Cited

U.S. PATENT DOCUMENTS

| | | | |
|---|---|---|---|
| 3,518,620 | 6/1970 | Bushey et al. . | |
| 4,257,659 | 3/1981 | Gibbs . | |
| 4,781,626 | 11/1988 | Lazarchik . | |
| 4,840,573 | 6/1989 | Seidel et al. . | |
| 4,875,865 | 10/1989 | Demler, Jr. et al. . | |
| 4,917,616 | 4/1990 | Demler, Jr. et al. . | |
| 4,986,769 | 1/1991 | Adams, III et al. . | |
| 5,026,306 | 6/1991 | Uekido et al. . | |
| 5,067,914 | 11/1991 | Seidel et al. . | |
| 5,278,535 | 1/1994 | Xu et al. . | |
| 5,307,242 | 4/1994 | Seibold et al. . | |
| 5,429,520 | 7/1995 | Morlion et al. | 439/108 |
| 5,429,528 | 7/1995 | Longueville et al. . | |
| 5,443,392 | 8/1995 | Longueville et al. . | |
| 5,479,321 | 12/1995 | Mari et al. . | |
| 5,509,823 | 4/1996 | Harting et al. . | |
| 5,549,481 | 8/1996 | Morlion et al. . | |

FOREIGN PATENT DOCUMENTS

| | | | |
|---|---|---|---|
| 0156539 | 3/1985 | European Pat. Off. | H01R 13/645 |
| 0179999 | 3/1985 | European Pat. Off. | H01R 13/64 |
| 0412331B1 | 7/1990 | European Pat. Off. | H01R 13/658 |
| 60-42468 | 12/1985 | Japan | H01R 9/09 |
| 8-162218 | 6/1996 | Japan | H01R 13/648 |
| 8-241762 | 9/1996 | Japan | H01R 13/648 |
| WO 94/06179 | 3/1994 | WIPO | H01R 23/68 |
| WO 94/10725 | 5/1994 | WIPO | H01R 13/658 |
| WO 94/10726 | 5/1994 | WIPO | H01R 13/658 |

*Primary Examiner*—Gary Paumen
*Assistant Examiner*—Alex Gilman
*Attorney, Agent, or Firm*—James C. Paschall

[57] ABSTRACT

A grounding shroud assembly is disclosed for mounting in an opening in a panel and for receiving a cable plug on one side of the panel and contact pins from a printed circuit board on an opposite side of the panel. A generally U-shaped conductive frame includes a base and a pair of sidewalls extending from the base and defining a receptacle therebetween for receiving the cable plug. The base has apertures therethrough for receiving the contact pins. A generally U-shaped conductive spring includes a base and a pair of sidewalls extending from the base for embracing the U-shaped frame. The spring facilitates mounting the shroud assembly in the opening in the panel. The base of the spring has apertures in registry with the apertures in the base of the frame for receiving the contact pins.

22 Claims, 9 Drawing Sheets

ELECTRICAL GROUNDING SHROUD

FIELD OF THE INVENTION

This invention generally relates to the art of electrical connector systems and, particularly, to a grounding shroud assembly for receiving a cable plug in a back panel wiring board arrangement.

BACKGROUND OF THE INVENTION

In shielded transmission systems located in the area of a back panel printed circuit board, grounding structures or shield assemblies are used to receive cable plugs for signal transfer. Often, the cable plugs are insertable next to one another and produce a disconnectable line connection.

For high frequency applications, all of the elements of the connecting system must conform to stringent electrical characteristics, such as impedance matching and grounding continuity. When the system is located between a printed circuit board or back panel and a coaxial cable plug, the electrical characteristics of the printed circuit board, of the male connector and of the female connector all are of importance. For example, the mating distance must be as small as possible. The board or back panel must also be protected against electrical emissions and radiations. This is done through the back panel being of conductive shielding material surrounding or covering the printed circuit board and its electrical components. The grounding shroud assembly of the present invention provides a small distance between the printed circuit board and the cable plug, and it also provides excellent grounding continuity between the board, the grounding panel and the plug connector.

SUMMARY OF THE INVENTION

An object, therefore, of the invention is to provide a new and improved grounding shroud assembly of the character described. As disclosed herein, the assembly is provided for receiving a cable plug on one side of the panel and contact pins from a printed circuit board on an opposite side of the panel.

In the exemplary embodiment of the invention, the grounding shroud assembly mounts in an opening in a panel. The assembly includes a generally U-shaped conductive frame including a base and at least a pair of side walls extending from the base. The frame thereby defines a receptacle for receiving the cable plug. The base of the frame has apertures for receiving the contact pins from the printed circuit board. A generally U-shaped conductive spring includes a base and at least a pair of side walls extending from the base for embracing the generally U-shaped frame. The spring facilitates mounting the shroud assembly in the opening in the panel. The base of the spring has apertures in registry with the apertures in the base of the frame for receiving the contact pins therethrough.

The frame is fabricated of such material as brass and is thicker and more robust than the spring. The spring is fabricated of thinner springy material such as beryllium copper.

As disclosed herein, the sidewalls of the spring have protrusions for engaging the inner edges of the opening in the panel. The protrusions are formed by integral, outwardly bowed portions of the sidewalls of the spring. The spring also includes portions extending around and into the inside of the sidewalls of the frame for engaging the cable plug. The portions are formed by integral, inwardly bowed portions of the sidewalls of the spring.

The frame is shown herein as being elongated and includes a plurality of the springs embracing the frame in a side-by-side relationship. The sidewalls of the frame include slots for mounting a conductive divider plate between the ends of adjacent side-by-side springs. The divider plate forms separate plug-receiving receptacles on opposite sides of the plate. Lastly, the divider plate includes stop flanges projecting outwardly of the sidewalls of the frame for engaging one side of the panel.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
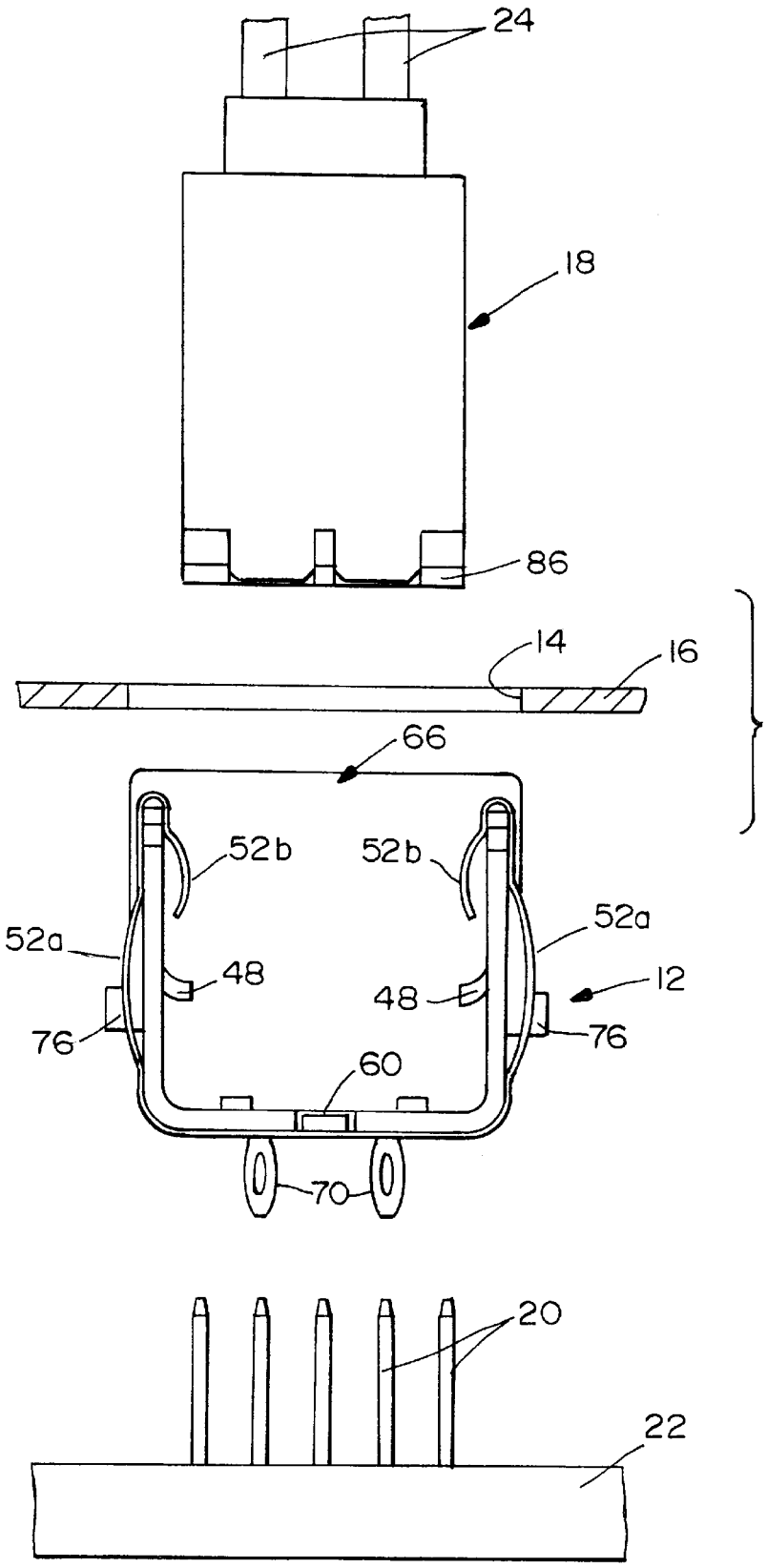
FIG. 1 is an end elevational view of the grounding shroud assembly of the invention in an exploded view in conjunction with, from top-to-bottom, a cable plug, a panel and a printed circuit board with contact pins.

Referring to the drawings in greater detail, and first to FIG. 1, the invention is embodied in a grounding shroud assembly, generally designated 12. The assembly is shown in FIG. 1 for mounting in an opening 14 in a panel 16 and for receiving a cable plug, generally designated 18, on one side of the panel and contact pins 20 from a printed circuit board 22 on the opposite side of the panel.

Figure 2:
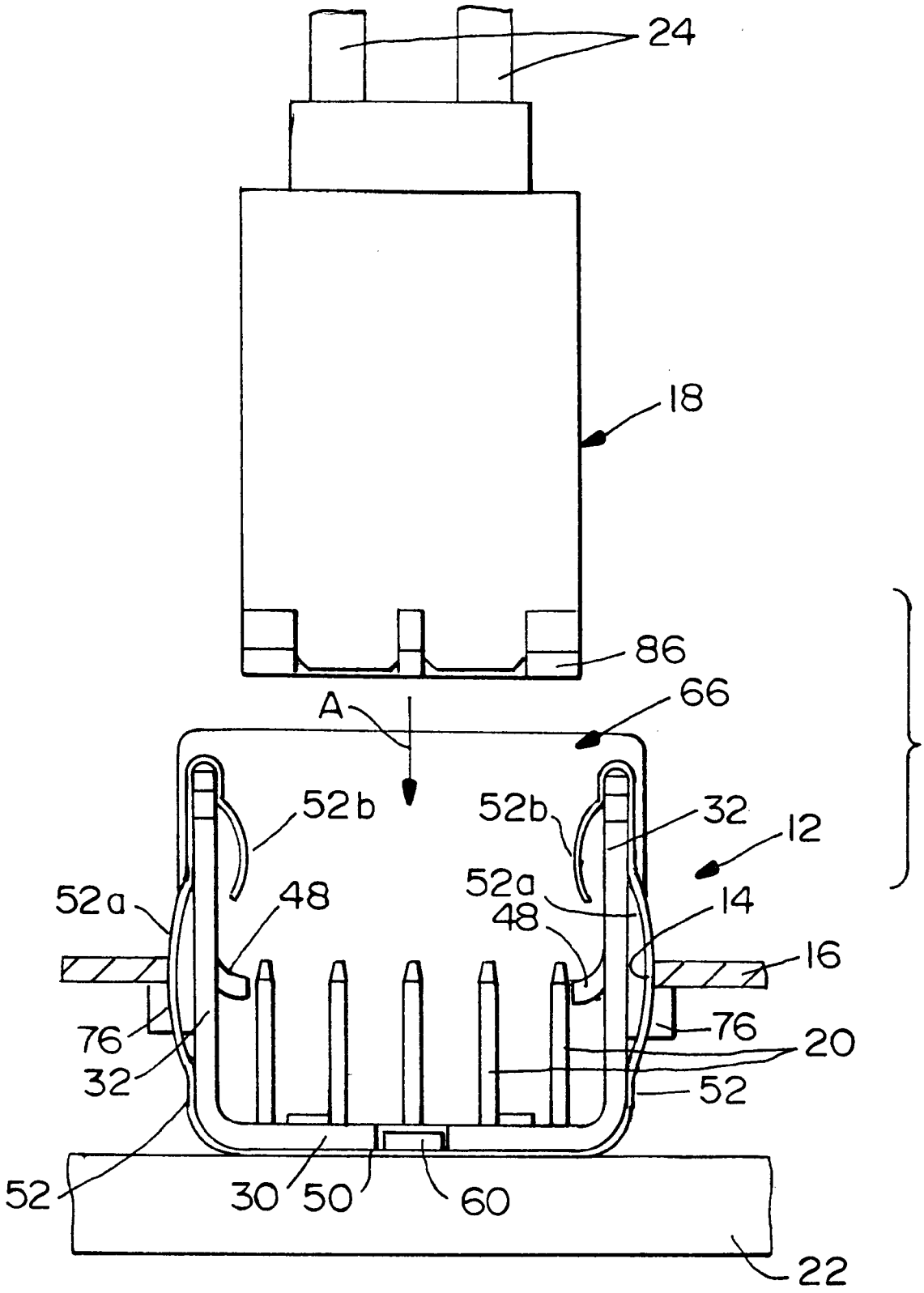
FIG. 2 is a view similar to that of FIG. 1, with the grounding shroud assembly mounted in the panel and connected to the printed circuit board, and with the cable plug about to be inserted into the grounding shroud assembly.

FIG. 2 shows grounding shroud assembly 12 mounted in opening 14 in panel 16. The assembly also is shown in FIG.

2 mounted on printed circuit board 22 with contact pins 20 projecting into the shroud assembly. Cable plug 18 is insertable into the shroud assembly in the direction of arrow "A".

At this point, it should be understood that printed circuit board 22 is of a generally conventional configuration, with conventional contact pins 20 projecting therefrom. Panel 16 is fabricated of conductive material and is part of a shielding casing for protecting components, such as electrical components on the printed circuit board, against electrical emissions and radiations. Except for its keying system, described hereinafter, cable plug 18 also is of a conventional construction with an outer shield and mounts a plurality of female terminals for receiving contact pins 20. The female terminals are terminated to conductors within shielded or coaxial cables 24.

Figure 3:
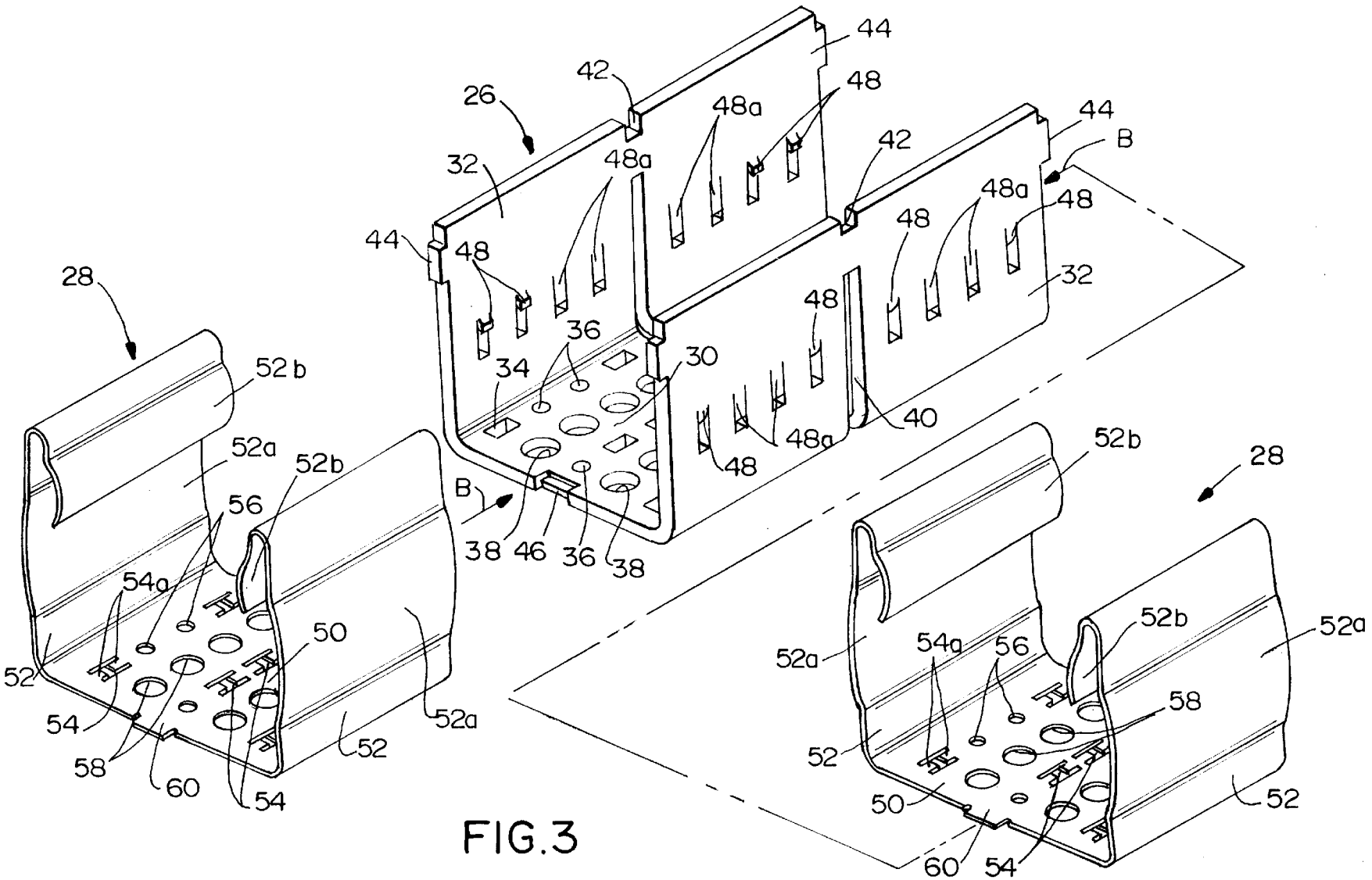
FIG. 3 is an exploded perspective view of the frame and a pair of the springs of the assembly.

Referring to FIG. 3, grounding shroud assembly 12 includes two main components, namely a frame, generally designated 26, and one or more springs, generally designated 28. The shroud assembly shown herein is designed for receiving a pair of cable plugs and, therefore, a divider plate (described hereinafter) is used to divide frame 26 into two distinct receptacles for the two plugs. Correspondingly, two separate springs 28 are employed.

Figure 4:
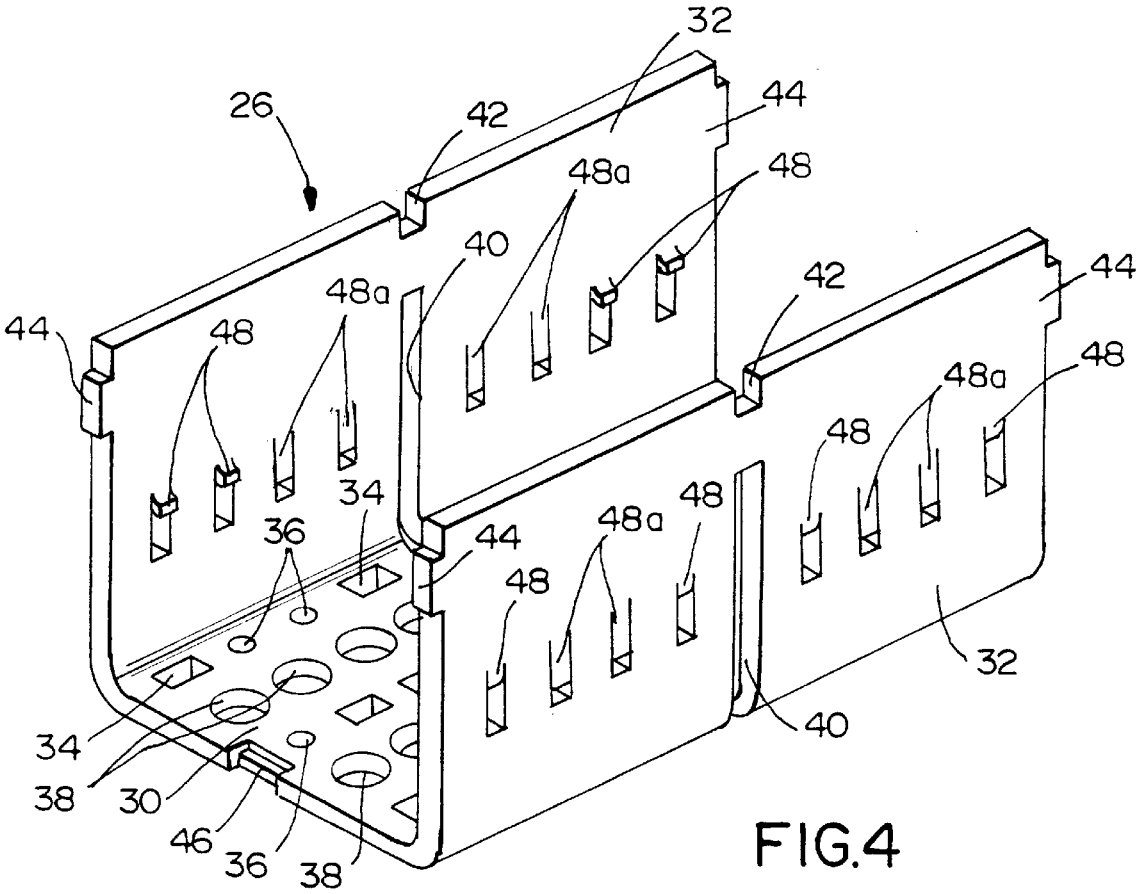
FIG. 4 is a perspective view of the frame.

Referring to FIG. 4 in conjunction with FIG. 3, frame 26 of grounding shroud assembly 12 is generally U-shaped and includes a base or bottom wall 30 and a pair of sidewalls 32 extending upwardly from the base. The frame is stamped and formed of conductive sheet metal material, such as brass, and base 30 and sidewalls 32 define a receptacle therebetween for receiving one or more of the cable plugs 18.

Frame 26 also includes a plurality of apertures 34, 36 and 38 therethrough for receiving contact pins 20 from printed circuit board 22. Apertures 34 are generally rectangular and freely receive ground pins from the printed circuit board. Apertures 36 are circular and also freely receive ground pins from the printed circuit board. Apertures 38 are circular and larger than apertures 36 and receive signal contact pins from the printed circuit board.

Frame 26 further includes slots 40 in sidewalls 32, along with notches 42 in the upper edges of the sidewalls. The slots and notches are provided for mounting a conductive divider plate, as described hereinafter. Tabs 44 project longitudinally outwardly from opposite ends of sidewalls 32, and base 30 includes notches 46 at opposite ends thereof. Tabs 44 are provided for mounting conductive end plates, as described hereinafter. Notches 46 facilitate mounting springs 28.

Lastly, a plurality of keying tabs 48 are formed out of sidewalls 32 and are bent inwardly of the frame. Unbent keying tabs 48*a* also are shown in FIGS. 3 and 4. The keying tabs operate with keying means on cable plugs 18, as described hereinafter.

Figure 5:
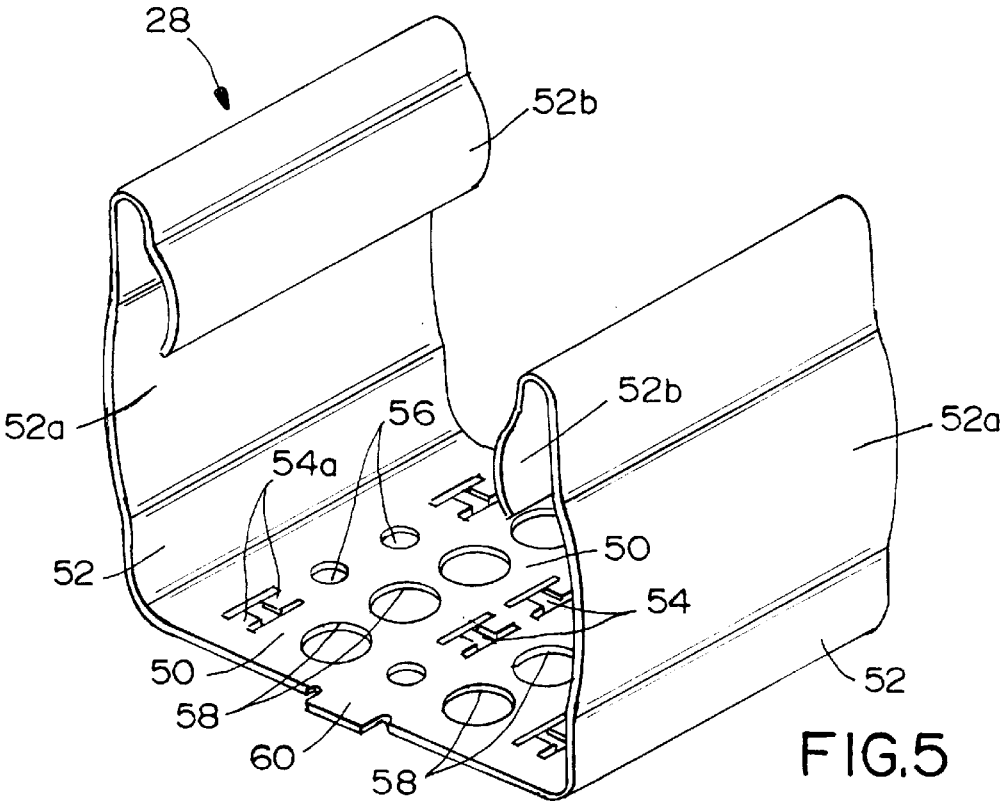
FIG. 5 is a perspective view of one of the springs.

Referring to FIG. 5 in conjunction with FIG. 3, each spring 28 is stamped and formed of conductive spring metal, such as beryllium copper, and includes a base 50 and a pair of upstanding sidewalls 52 extending from the base for embracing the generally U-shaped frame 26. Sidewalls 52 have protrusions in the form of integral outwardly bowed portions 52*a* for engaging inner edges of opening 14 in panel 16 to mount the grounding shroud assembly in the panel as shown in FIG. 2. The spring also includes integral, inwardly bowed portions 52*b* which extend around and into the inside of sidewalls 32 of frame 26 for frictionally and electrically engaging the outer shield of the cable plug 18.

Each spring 28 of grounding shroud assembly 12 includes a plurality of apertures 54, 56 and 58 through base 50 of the spring. Apertures 54 are H-shaped to define a pair of opposing tabs 54*a* which deform and grip the ground contact pins which extend therethrough. This functions to mount the grounding shroud assembly onto printed circuit board 22 as shown in FIG. 2. Apertures 56 are circular and freely receive the remainder of the ground pins from the printed circuit board. All of the apertures for receiving the ground pins are not H-shaped in order to avoid excessive mounting forces. Apertures 58 freely receive the signal contact pins from the printed circuit board. H-shaped apertures 54 in base 50 of spring 28 register with rectangular apertures 34 in base 30 of frame 26; smaller round apertures 56 in the spring(s) register with smaller round apertures 36 in the frame and larger round apertures 58 in the spring register with larger round apertures 38 in the frame. Lastly, a tab 60 projects outwardly from base 50 at the end of each spring 28, for purposes to be described hereinafter.

Figure 6:
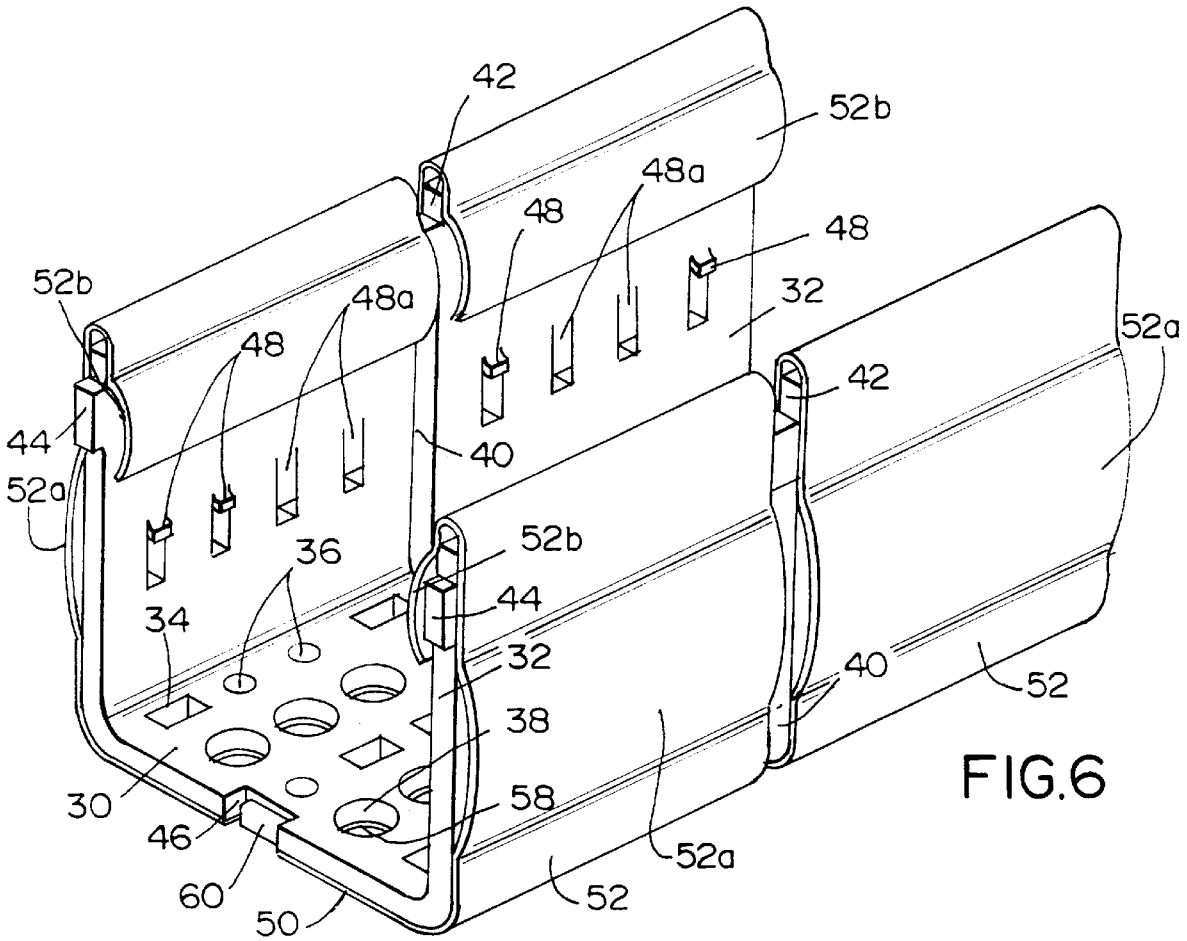
FIG. 6 is a perspective view of the springs mounted on the frame.

U-shaped conductive springs 28 are mounted on U-shaped conductive frame 26 by sliding the springs onto opposite ends of the frame in the direction of arrows "B" in FIG. 3. FIG. 6 shows the two springs fully mounted on and embracing the frame. Once in their fully mounted positions, tabs 60 at the ends of bases 50 of the springs are bent into notches 46 in base 30 of the frame.

Figure 6B:
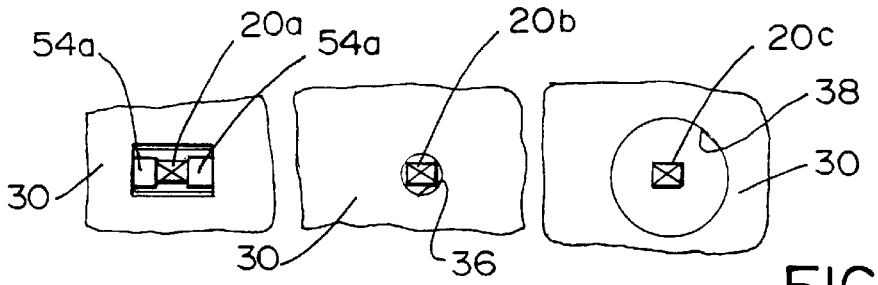
FIG. 6B is a fragmented top plan view looking downwardly on the arrangement of FIG. 6A.
Figure 6A:
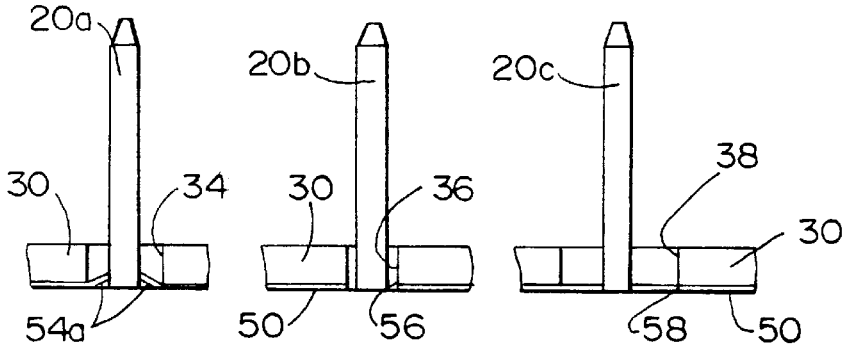
FIG. 6A is a fragmented elevational view of three contact pins projecting through apertures in the spring and the frame.

FIGS. 6A and 6B show contact pins from the printed circuit board inserted into the apertures in the base of the spring and the base of frame of grounding shroud assembly 12. More particularly, contact pin 20A in FIGS. 6A and 6B designates a ground pin inserted through H-shaped aperture 54 in the spring and through rectangular aperture 34 in the frame. Opposing tabs 54*a* grip the ground pin to effectively mount the grounding shroud assembly onto the printed circuit board. Contact pin 20B in FIGS. 6A and 6B represents another ground pin from the printed circuit board which extends freely through small round aperture 56 in the spring and small round aperture 36 in the frame. Contact pin 20C in FIGS. 6A and 6B represents a signal pin from the printed circuit board extending freely through larger round aperture 58 in the spring and larger round aperture 38 in the frame. The signal pins pass through larger apertures which are adapted to the impedance characteristics to be achieved with the connector arrangement.

Figure 7:
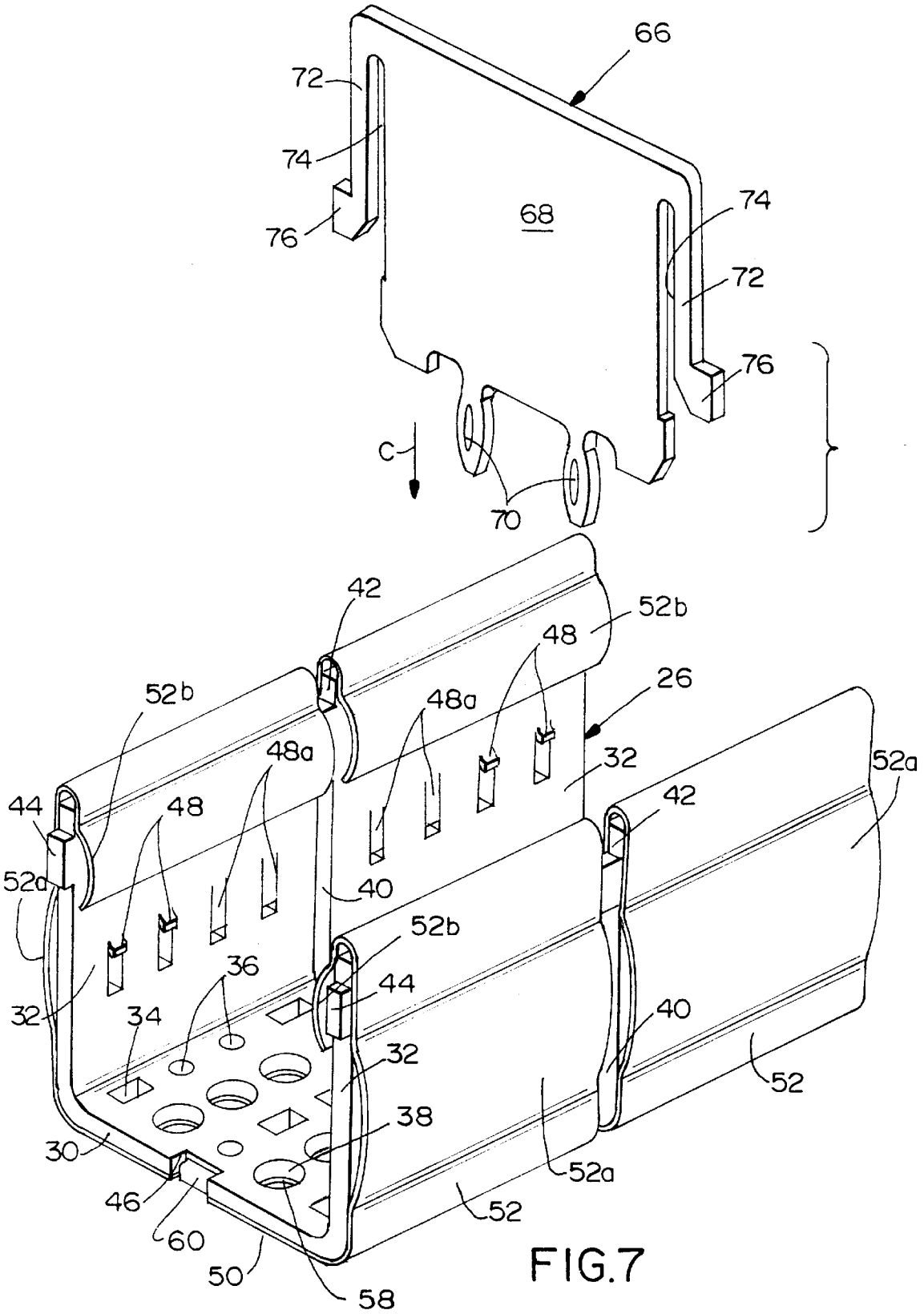
FIG. 7 is a view similar to that of FIG. 6, with the divider plate of the assembly about to be mounted thereon.

Referring to FIG. 7, a divider plate, generally designated 66, is shown to include a generally planar body 68 having a pair of mounting legs 70 projecting downwardly therefrom. A pair of arms 72 are spaced outwardly from opposite edges of the body to define grooves 74. The arms terminate in outwardly projecting stop flanges 76. The divider plate is stamped from conductive sheet metal material approximately the same thickness as the sheet metal material of frame 26.

Figure 8:
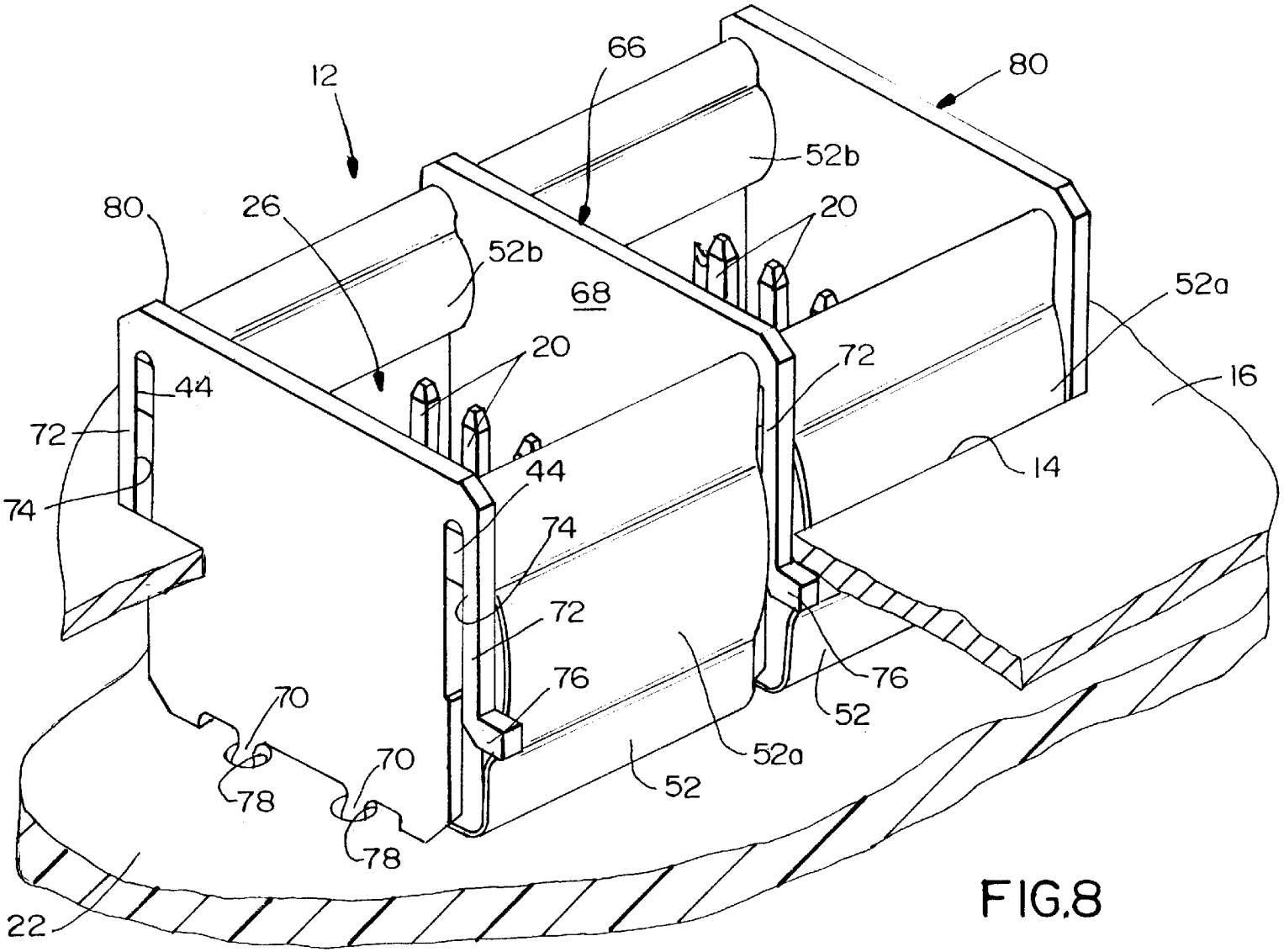
FIG. 8 is a perspective view of the completed assembly mounted in the opening in the panel and on the printed circuit board.

Divider plate 66 is mounted onto frame 26 in the direction of arrow "C" (FIG. 7) until the divider plate assumes a position shown in FIG. 8, dividing the frame into two distinct receptacles for a pair of cable plugs 18. As the divider plate is mounted onto the frame, sidewalls 32 of the frame move into grooves 74 inside arms 72 of the divider plate, until the bottoms of the grooves seat into notches 42 at the tops of the sidewalls of the frame. Mounting legs 70 at the bottom of the divider plate extend into mounting holes 78 (FIG. 8) in printed circuit board 22.

FIG. 8 also shows that a pair of end plates, generally designated 80, are used to close the ends of the grounding shroud assembly. End plates 80 are of substantially identical construction to divider plate 66 and, accordingly, like reference numerals have been applied to like portions of the end plates corresponding to the same portions of the divider plate. It can be seen in FIG. 8 that the end plates are mounted at the opposite ends of frame 26, with tabs 44 at the opposite ends of sidewalls 32 of the frame press fit into grooves 74 inside arms 72 of the end plates. Mounting legs 70 of the end plates project into mounting holes 78 in printed circuit board 22.

After grounding shroud assembly 12 is mounted onto printed circuit board 22 as shown in FIG. 8, this subassembly is mounted in opening 14 in panel 16, with the panel abutting against stop flanges 76 of divider plate 66 and end plates 80.

With frame 26 being fabricated of a thicker more robust material, such as brass or the like, the frame provides a sturdy structure forming the receptacles for receiving the cable plugs. Springs 28 being fabricated of a thinner springy material, such as beryllium copper or the like, provides a yielding structure for mounting in the panel opening, as well as gripping the plugs and the contact pins in H-shaped apertures 54. Moreover, the unbreached surface of the springs 28 provides shielding against emissions and radiations which the openings provided by the keying tabs 48, 48*a* may otherwise permit to pass.

Figure 9:
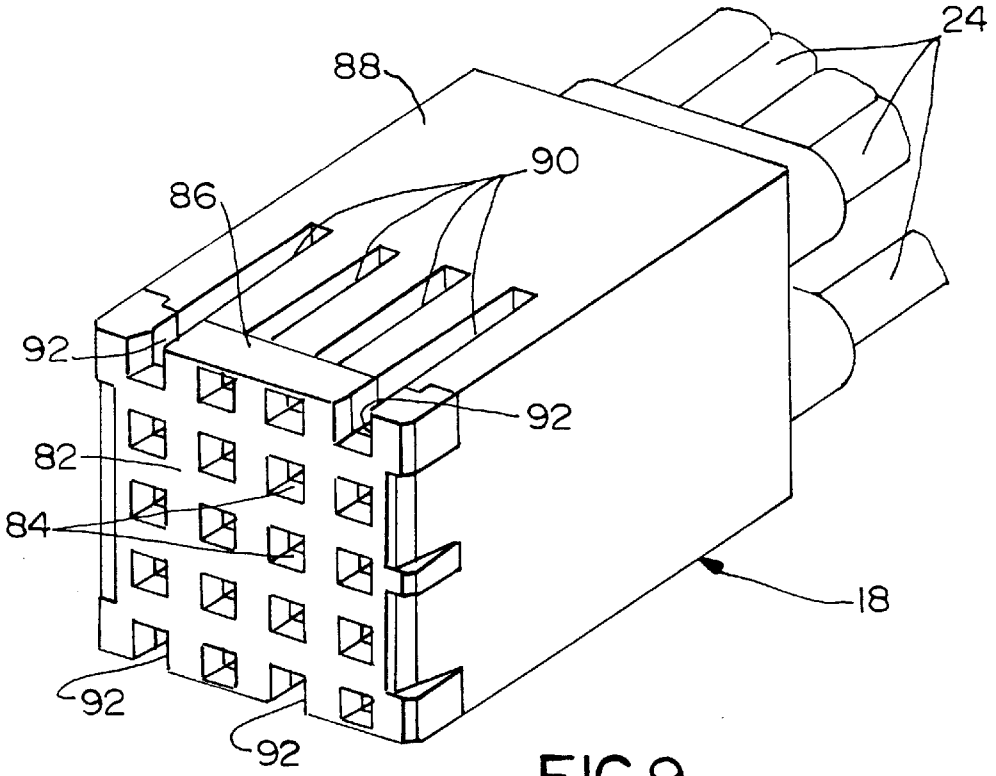
FIG. 9 is a perspective view of the mating end of the cable plug.

FIG. 9 shows cable plug 18 to include a mating end face 82 having a plurality of passages 84 for receiving contact pins 20 from printed circuit board 22. The passages lead to a plurality of female terminals or contacts within the cable plug and which mate with the contact pins. Mating face 82 is defined by a face 86 mounted on a dielectric housing 88 of the cable plug.

Figure 10:
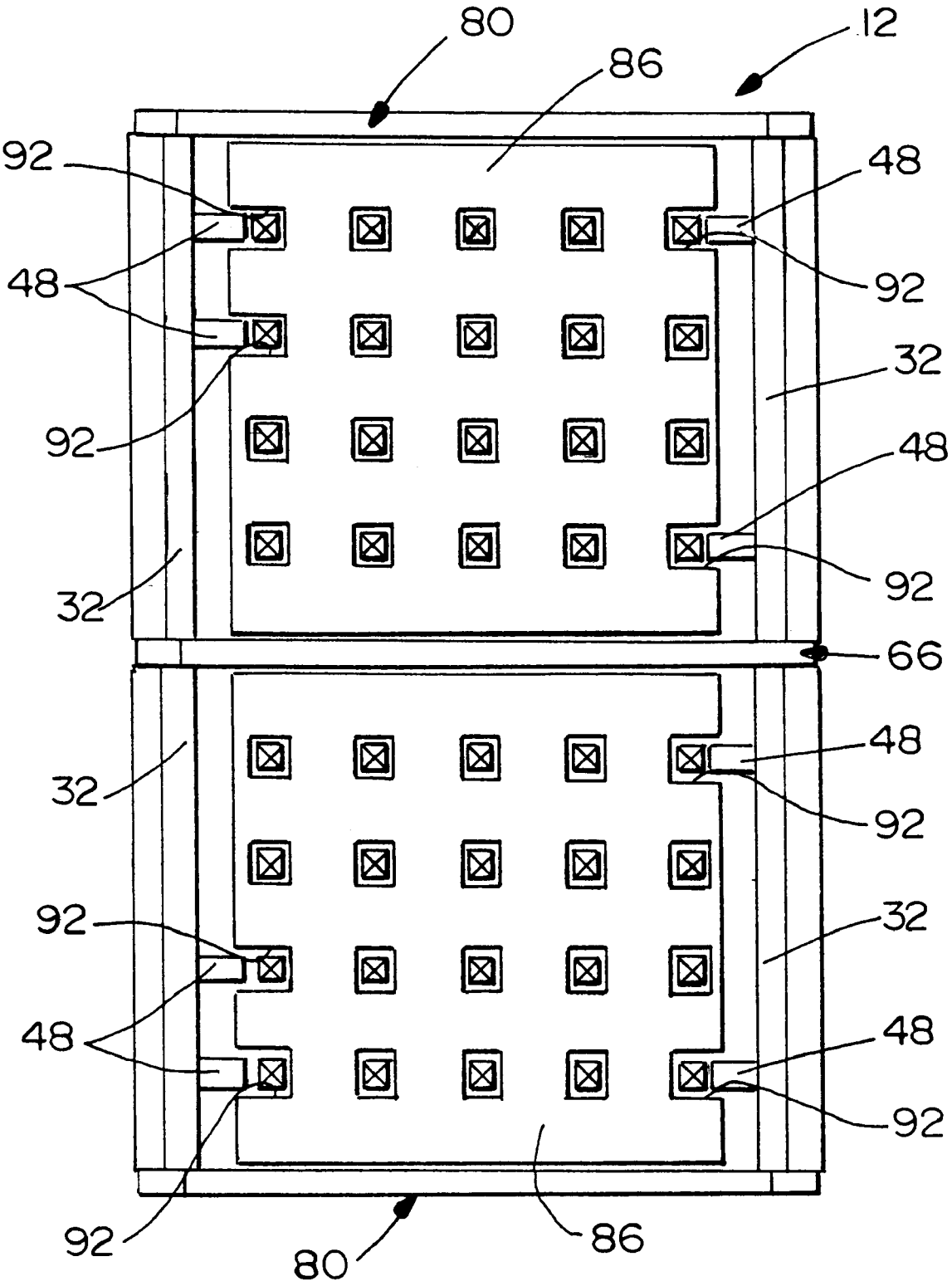
FIG. 10 is a plan view showing two cable plugs with the keying arrangements of FIGS. 9A and 9B inserted into a grounding shroud assembly with a similar keying setup.

Grounding shroud assembly 12 described above in relation to FIGS. 1–8 and cable plugs 18 include a unique keying system to prevent any given cable plug from being inserted into a wrong receptacle or side of grounding shroud assembly 12. More particularly, FIG. 10 shows that opposite sides of housing 88 of the cable plug is provided with a plurality of keying grooves 90. Face plate 86 is provided with a plurality of keying notches 92. The keying notches align with selected ones of keying grooves 90. For instance, in FIG. 9, keying grooves 92 at the top of face plate 86 are aligned with the outermost keying grooves 80 of the housing. However, keying notches 92 at the bottom of face plate 86 are aligned with the first and third keying grooves at the bottom of the housing, as looking from the left in the depiction. Therefore, the top of the cable plug may be keyed differently from the bottom of the cable plug.

Figure 9A:
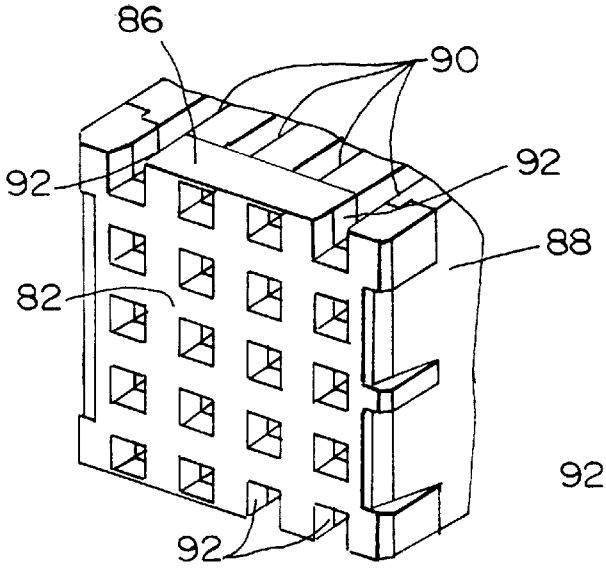
FIGS. 9A and 9B are fragmented perspective views of the mating ends of two cable plugs having different keying arrangements.
Figure 9B:
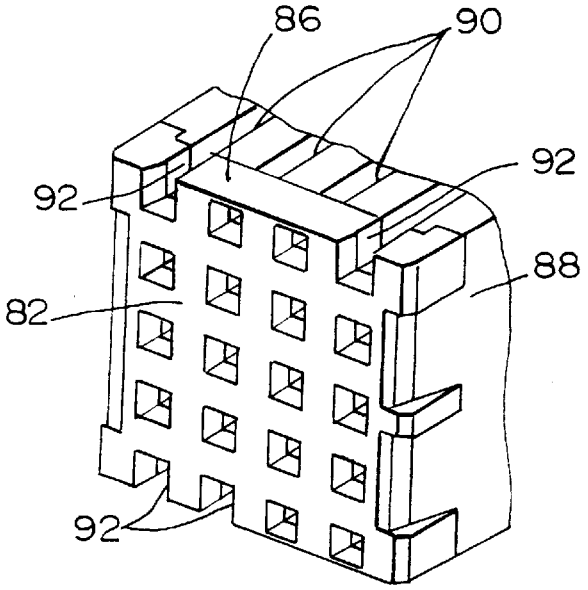

Turning to FIGS. 9A and 9B, it can be seen that the keying arrangement at the top of the cable plugs shown therein are the same as the keying arrangement at the top of the cable plug in FIG. 9. In other words, keying notches 92 in face plates 86 are open to the two outermost keying grooves 90 in plug housing 88. The center two keying grooves 90 at the top of the housing are blocked by face plate 86.

However, looking at the bottom of the cable plugs shown in FIGS. 9A and 9B, it can be seen that face plate 86 in FIG. 9A is provided with two keying notches at the right-hand end thereof, and face plate 86 in FIG. 9B is provided with two keying notches 92 at the left-hand end thereof. Therefore, the cable plug shown in FIG. 9A is keyed different from the cable plug shown in FIG. 9B.

Now, turning to FIG. 10, it can be seen that keying tabs 48 have been bent inwardly from sidewalls 32 of frame 26 to match the keying notches 92 in face plates 86 of the cable plugs. In other words, the cable plug shown in FIG. 9A is insertable into grounding shroud assembly 12 at the top of FIG. 10, and the cable plug shown in FIG. 9B is insertable into the bottom of the grounding shroud assembly in FIG. 10. The two cable plugs cannot be interchanged in the respective receptacles on opposite sides of divider plate 66 because of this keying arrangement.

It is readily apparent that by providing plug housing 88 with a plurality of keying grooves 90 as shown in FIG. 9, only some or all of the keying grooves can be exposed for receiving keying tabs 48 of the shroud assembly, simply by changing face plate 86 and its respective, selected arrangement of keying notches 92. Therefore, the entire plug housing does not have to be changed to change the keying arrangement. Only the face plate 86, with a selected arrangement of keying notches 92, must be changed to change the keying system. Similarly, keying tabs 48 in the sidewalls 32 of frame 26 easily are bent inwardly or cut at selected locations corresponding to the locations of the keying notches in the respective cable plug. The keying tabs 48 can be cut with a small cutting tool even when the spring 28 is already in position and preventing access to the exterior of the frame 26.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A grounding shroud assembly for mounting in an opening in a panel and for receiving a cable plug on one side of the panel and contact pins from a printed circuit board on an opposite side of the panel, comprising:

a generally U-shaped conductive frame including a base and at least a pair of sidewalls extending from the base and defining a receptacle therebetween for receiving said cable plug, the base having apertures therethrough for receiving said contact pins; and a generally U-shaped conductive spring including a base and at least a pair of sidewalls extending from the base for embracing the generally U-shaped frame and facilitating mounting the shroud assembly in the opening in the panel, the base of the spring having apertures in registry with the apertures in the base of the frame for receiving the contact pins.

2. The grounding shroud assembly of claim 1 wherein the sidewalls of said spring have protrusions for engaging inner edges of the opening in the panel.

3. The grounding shroud assembly of claim 2 wherein said protrusions comprise integral, outwardly bowed portions of the sidewalls of the spring.

4. The grounding shroud assembly of claim 1 wherein said spring includes portions extending around and into the inside of the sidewalls of the frame for engaging the cable plug.

5. The grounding shroud assembly of claim 4 wherein said portions comprise integral, inwardly bowed portions of the sidewalls of the spring.

6. The grounding shroud assembly of claim 1 wherein said frame is elongated, and including a plurality of said springs embracing the frame in a side-by-side relationship.

7. The grounding shroud assembly of claim 6 wherein the sidewalls of the frame include slots for mounting a conductive divider plate between the ends of adjacent side-by-side springs.

8. The grounding shroud assembly of claim 1 wherein said frame is elongated, and including at least one conductive divider plate extending between the sidewalls of the frame and forming separate plug-receiving receptacles on opposite sides of the plate.

9. The grounding shroud assembly of claim 8 wherein the sidewalls of the frame include slots for mounting the divider plate.

10. The grounding shroud assembly of claim 8 wherein said divider plate includes stop flanges projecting outwardly of the sidewalls of the frame for engaging one side of said panel.

11. The grounding shroud assembly of claim 8 wherein said divider plate includes mounting legs projecting through the frame and the spring into appropriate mounting holes in the printed circuit board.

12. A grounding shroud assembly, comprising:

a conductive frame including a base and at least a pair of opposed sidewalls extending from the base, the base having apertures therein for receiving appropriate contacts;

a conductive spring including a base and at least a pair of opposed sidewalls extending from the base, the base having apertures therein for receiving the contacts; and wherein the frame is nested within the spring, and the apertures in the base of the frame are in registry with the apertures in the base of the spring.

13. The grounding shroud assembly of claim 12 wherein the sidewalls of said spring have protrusions for engaging inner edges of an opening in an appropriate panel.

14. The grounding shroud assembly of claim 13 wherein said protrusions comprise integral, outwardly bowed portions of the sidewalls of the spring.

15. The grounding shroud assembly of claim 12 wherein said spring includes portions extending around and into the inside of the sidewalls of the frame for engaging an appropriate cable plug.

16. The grounding shroud assembly of claim 15 wherein said portions comprise integral, inwardly bowed portions of the sidewalls of the spring.

17. The grounding shroud assembly of claim 12 wherein said frame is elongated, and including a plurality of said springs embracing the frame in a side-by-side relationship.

18. The grounding shroud assembly of claim 17 wherein the sidewalls of the frame include slots for mounting a conductive divider plate between the ends of adjacent side-by-side springs.

19. The grounding shroud assembly of claim 12 wherein said frame is elongated, and including at least one conductive divider plate extending between the sidewalls of the frame and forming separate plug-receiving receptacles on opposite sides of the plate.

20. The grounding shroud assembly of claim 19 wherein the sidewalls of the frame include slots for mounting the divider plate.

21. The grounding shroud assembly of claim 19 wherein said divider plate includes stop flanges projecting outwardly of the sidewalls of the frame for engaging one side of an appropriate panel.

22. The grounding shroud assembly of claim 19 wherein said divider plate includes mounting legs for projecting through the frame and the spring into appropriate mounting holes in a printed circuit board.

* * * * *